US006116595A

United States Patent [19]

d'Agrella et al.

[11] Patent Number: 6,116,595

[45] Date of Patent: Sep. 12, 2000

[54] SHEET DIVERTER WEDGE INCLUDING AIR DISCHARGE PORTS

[75] Inventors: Ingermar S. d'Agrella, Sussex; Karl P. Schaefer, Brookfield, both of Wis.

[73] Assignee: Quad/Graphics, Inc., Sussex, Wis.

[21] Appl. No.: 09/059,212

[22] Filed: Apr. 13, 1998

[51] Int. Cl.[7] ..... B65H 29/58

[52] U.S. Cl. ..... 271/279; 271/303; 271/195

[58] Field of Search ..... 271/279, 283, 271/303, 302, 305, 195; 83/105, 106; 270/58.33

[56] References Cited

U.S. PATENT DOCUMENTS

| | | | |
|---|---|---|---|
| 2,906,189 | 9/1959 | Robertson | 95/77.5 |
| 3,224,761 | 12/1965 | Meyer-Jagenberg | 271/68 |
| 3,236,517 | 2/1966 | Lyman | 271/5 |
| 3,243,181 | 3/1966 | Lyman | 271/64 |
| 3,262,699 | 7/1966 | Aschenbrenner | 271/45 |
| 3,844,189 | 10/1974 | Jardine | 83/98 |
| 4,003,568 | 1/1977 | Stange et al. | 271/225 |
| 4,060,235 | 11/1977 | Weikel, Jr. | 271/174 |
| 4,084,806 | 4/1978 | Wenthe et al. | 271/80 |
| 4,165,132 | 8/1979 | Hassan et al. | 406/10 |
| 4,373,713 | 2/1983 | Loebach | 271/303 |
| 4,405,126 | 9/1983 | Frye et al. | 271/195 |
| 4,534,552 | 8/1985 | Rahe | 271/279 |
| 4,729,282 | 3/1988 | Kasdorf | 83/26 |
| 4,736,942 | 4/1988 | Wiley | 271/284 |
| 4,948,112 | 8/1990 | Sato et al. | 270/60 |
| 5,213,316 | 5/1993 | Loebach | 270/47 |
| 5,325,608 | 7/1994 | Mayer | 34/114 |
| 5,398,925 | 3/1995 | Zeltner | 271/276 |
| 5,425,217 | 6/1995 | Lobash et al. | 53/435 |
| 5,636,450 | 6/1997 | Lizé | 34/267 |

FOREIGN PATENT DOCUMENTS

| | | | |
|---|---|---|---|
| 54-0070560 | 6/1979 | Japan | 271/279 |
| 59-0198251 | 11/1984 | Japan | B65H 29/58 |
| 63-0154574 | 6/1988 | Japan | B65H 29/60 |

*Primary Examiner*—H. Grant Skaggs
*Attorney, Agent, or Firm*—Michael Best & Friedrich LLP

[57] ABSTRACT

A diverter wedge for a pinless folder is adapted for cooperative association with a diverter guide mechanism operating to direct the lateral disposition of the leading edge of a signature relative to the wedge to one of a plurality of collation paths. The diverter wedge includes an elongated bar having a longitudinal axis and a generally triangular cross section transverse to said longitudinal axis. The bar is fixed in position and also includes a base, a vertex edge opposite the base, and planar diversion surfaces diverging from the vertex edge, an air inlet port connectable to a source of pressurized air, and a plurality of air discharge ports connected to the air inlet port and intersecting one of the planar diversion surfaces. At least one air discharge port intersects the vertex edge.

13 Claims, 3 Drawing Sheets

22
12
24
14
26

28
10
50
32
52
54
56
16
34
88
70
82
88
102
36
120
18
38
104
40
60
58
42
108
112
122
124
66
68
A
84
86
B
43
45
72
74
88
88
90
100
100
90
78
93
95
80
92
20
62
96
94
64
46
46
98

SHEET DIVERTER WEDGE INCLUDING AIR DISCHARGE PORTS

FIELD OF THE INVENTION

The invention relates to a sheet diverter wedge for a pinless folder. In particular, the invention relates to a sheet diverter wedge having a plurality of air discharge ports that discharge pressurized air and exert desirable forces on signatures as they are diverted.

BACKGROUND OF THE INVENTION

In the printing industry, a desired image is repeatedly printed on a continuous web or substrate such as paper. The ink is dried by running the web through curing ovens. In a typical printing process, the web is subsequently slit (in the longitudinal direction which is the direction of web movement) to produce a plurality of continuous ribbons. The ribbons are aligned one on top of the other, folded longitudinally, and then cut laterally to produce a plurality of multi-paged, approximately page-length web segments, termed "signatures". A signature can also be one printed sheet of paper that has or has not been folded. It is often desirable to transport successive signatures in different directions. In general, a sheet diverter operates to route a signature along a desired one of a plurality of paths.

U.S. Pat. No. 4,373,713 discloses a pair of rotary diverters (62, 63) having cam surfaces which divert successive signatures alternately to opposite sides of a diverter wedge (23). After passing the wedge, the signatures are engaged by a belt system, comprising inner belts (25, 26) and outer belts (12, 13), that transport the signatures to the next operation.

Similarly, U.S. Pat. No. 4,729,282 discloses a sheet diverter including an oscillating diverter guide member that directs successive signatures to opposite sides of a diverter wedge.

A sheet diverter in a folder at the end of a printing press line must be operable at the high speeds of the press line, typically in excess of 2,000 feet per minute (fpm). It is desirable to run both the press and folder at the highest speed possible in order to produce as many printed products as possible in a given amount of time. However, the physical qualities of paper or similar flexible substrates moving at a too high rate of speed often results in whipping, dog-earring, tearing, or bunching of the substrate. For example, the sudden impact force between the leading edge of a signature and the diverter wedge may result in the leading edge of the signature being damaged. Similarly, the trailing edge of a signature may slap against the top vertex edge of the diverter wedge, resulting in damage to the trailing edge. The trailing edge of the signature may tear, or be unintentionally folded on the corners. Damaged signatures may be of unacceptable quality and may also lead to jams in the folder, resulting in downtime and repair expense.

Additionally, the ink on a printed signature can be smeared, smudged, or offset to the wedge when the signature strikes the diverter wedge at a high rate of speed. Ink offset on the diverter wedge can also cause undesired smudges on successive signatures.

Many of these defects become more prevalent above certain speeds of the printing press and folder. For example, such defects may occur when the press is run at 2300 fpm, but may not occur when the press is run at 2200 fpm.

SUMMARY OF THE INVENTION

It is an object of the invention to provide an apparatus that minimizes the potential for damage to the signatures in a folder.

A principal advantage of the invention is the minimization of damage to the leading and trailing edges of a signature diverted through a folder, while allowing the printing press and the folder to operate at higher rates of speed.

Another advantage of the invention is the minimization of ink offset to the diverter wedge, while allowing the printing press and the folder to operate at higher rates of speed.

The invention provides a diverter wedge for a pinless folder, wherein the diverter wedge is adapted for cooperative association with a diverter guide mechanism operating to direct the lateral disposition of a leading edge of a signature relative to the wedge to one of a plurality of collation paths. The diverter wedge includes an elongated bar having a longitudinal axis and a generally triangular cross section transverse to the longitudinal axis. The bar is fixed in position and includes a base, a vertex edge opposite the base, and planar diversion surfaces diverging from the vertex edge. The wedge also includes at least one air inlet port connectable to a source of pressurized air and a plurality of air discharge ports connected to the air inlet port and intersecting the planar diversion surfaces. In one embodiment, at least one air discharge port intersects the vertex edge.

In another aspect, the invention provides a sheet diverter for diverting a signature to one of a plurality of collation paths and adapted for cooperative association with a cutting device in a pinless folder wherein a web is cut into a plurality of individual signatures. The sheet diverter includes a diverter guide mechanism for directing the lateral disposition of the leading edge of a signature to one of the plurality of collation paths. The sheet diverter further includes a diverter wedge separating the plurality of collation paths. The diverter wedge includes a generally triangular body having planar diversion surfaces diverging from a vertex edge, an air inlet port connectable to a source of pressurized air, and a plurality of air discharge ports connected to the air inlet port and intersecting the planar diversion surfaces. The sheet diverter also includes signature control means downstream of the wedge vertex including a nip defined by rollers and tapes, wherein the nip is offset from the plane defined by one of the planar diversion surfaces, and wherein pressurized air through the air discharge ports directs the leading edge of the signature to this nip.

Other features and advantages of the invention will become apparent to those skilled in the art upon review of the following detailed description, claims and drawings.

Figure 1:
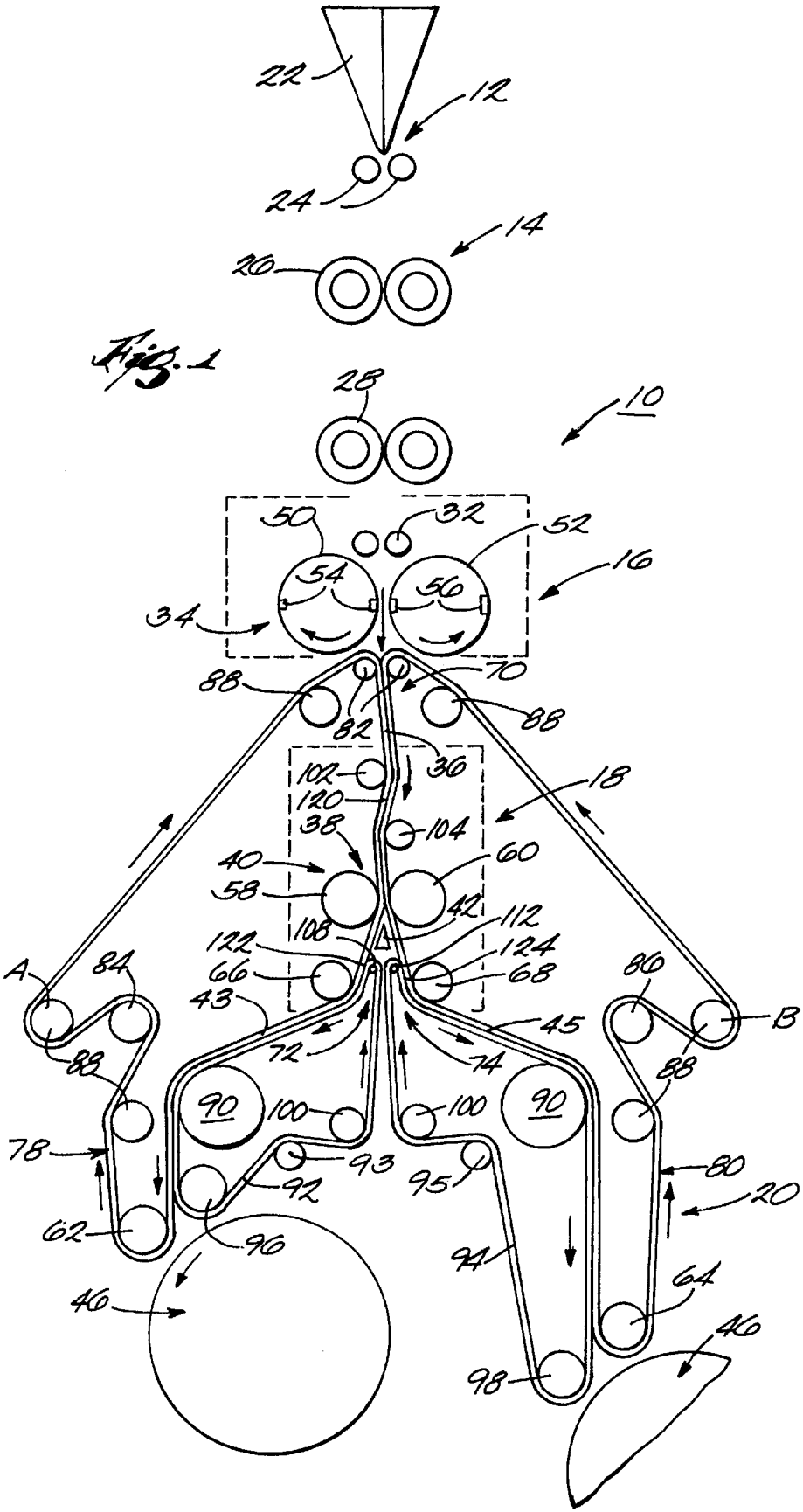
FIG. 1 is a schematic diagram of a pinless folder incorporating a diverter wedge in accordance with the present invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

BRIEF DESCRIPTION OF THE PREFERRED EMBODIMENT

Illustrated in FIG. 1 of the drawings is a schematic of a folder 10 which is a portion of a high speed printing press. The folder 10 includes a forming section 12, a driving section 14, a cutting section 16, a diverting section 18, and a collating section 20.

In particular, the forming section 12 includes a generally triangularly shaped former board 22 which receives a web of material (or several longitudinally slit sections of the web termed "ribbons", wherein the ribbons are typically aligned one on top of the other) and folds the same. The fold is in a direction parallel to the direction of web travel. The folded web is then fed downwardly under the influence of a pair of squeeze rolls 24 by the drive section 14. The drive section 14 includes pairs of upper and lower drive rolls, 26 and 28 respectively. These drive rolls transport the web to conditioning rolls 32 in the cutting section 16. The web then passes into engagement with a cutting device 34. The web is segmented by the cutting device 34 into a plurality of individual signatures. Successive signatures enter the diverting section 18 along a diverter path 36. The signatures are led serially via opposed tapes to a sheet diverter 38, which includes an oscillating diverting guide mechanism 40 and a diverter wedge 42. The sheet diverter 38 deflects a signature to a selected one of a plurality of collation paths 43, 45. The signature then enters the collating section 20 and is fed along one of the collation paths to a destination such as a fan delivery device 46 and subsequently to a conveyor (not shown), such as a shingling conveyor as is known in the art.

More specifically, the cutting device 34 includes a pair of counter-rotating cutting cylinders 50 and 52. One cylinder is fitted with a pair of cutting knives 54 and the other is formed with a pair of recesses 56. Since the cylinders include pairs of knives and opposed recesses, two cutting actions are achieved per single cylinder rotation. Suitable timing means, known to those of ordinary skill in the art, provide accurate registration of the image on the web with respect to the cutting device 34 to ensure proper cut dimensions for the web segments.

As mentioned, the sheet diverter 38 includes the oscillating diverting guide mechanism 40 and the diverter wedge 42. The mechanism 40 includes a pair of diverter idler rolls 58, 60, which are mounted on driven rotating eccentrics (not shown). The mechanism 40 operates to direct the lateral disposition of the leading edge of the signature relative to the wedge 42 which separates the two collation paths 43, 45. The mechanism 40 basically reciprocates in a diverter plane which has a component generally perpendicular to the diverter path 36. One such diverter is described in U.S. Pat. No. 4,729,282, assigned to Quad/Tech of Pewaukee, Wis., which patent is hereby incorporated by reference. Alternately, a diverting guide mechanism such as that disclosed in U.S. Pat. No. 4,373,713 could be used in connection with the present invention, as could other known diverting guide mechanisms.

The signatures are routed through the diverter path 36 and to a selected one of the collation paths 43, 45 under the control of signature control means including a primary signature control means 70 and secondary signature control means 72, 74. In the preferred embodiment, the distance through the diverter between the primary signature control means 70 and respective secondary signature control means 72, 74 is less than the length of the signature to be diverted. Accordingly, the selected secondary signature control means assumes control of the leading edge 125 of the signature 126 before the primary signature control means releases control of the trailing edge 127 of the same signature. As used herein, the leading edge and trailing edge refer to the first or last inch or so of the signature. The diverting guide mechanism 40 does not exert compressive control over the signature being diverted.

The primary and secondary signature control means preferably are comprised of opposed (face-to-face) belts or tapes disposed over rollers in an endless belt configuration. More specifically, the primary signature control means includes a first diverter belt 78 and a second diverter belt 80 which circulate in separate continuous loops in the directions shown, and are joined at a nip between a set of idler rollers 82 near the outfeed of the cutting section 16. Drive rollers 84 and 86 drive the diverter belts 78 and 80 respectively about idler roller 82, a plurality of idler rollers 88, respective idler rollers 62, 64, and respective idler rollers 66, 68. Both diverter belts 78, 80 are driven by respective drive rollers 84, 86 at the same speed, which typically is from 8% to 15% faster than the speed of the printing press. The faster speed of the belts causes a gap to occur between successive signatures as the signatures flow serially down path 36 between the diverter belts 78, 80. The diverter belts 78, 80 are also driven around guide rollers 90. Guide rollers 90 have larger diameters than the other rollers so that when the direction of the signatures is changed, the signatures are bent as little as possible to avoid damage due to wrinkles at the backbone of the signature.

The primary signature control means 70 also includes a soft nip 120 defined by an idler roller 102 and an abaxially disposed idler roller 104. The rollers 102 and 104 cause pressure between diverter belts 78 and 80 as these belts follow the diverter path 36 through the soft nip 120. The soft nip 120 compressively captures and positively drives a signature that passes therethrough.

Similarly, the secondary signature control means 72, 74 includes a first collator belt 92 and a second collator belt 94 which also both circulate in separate continuous loops in the directions shown. The opposed collator belts 92, 94 share a common path with the diverter belts 78, 80 along the collation paths 43, 45 beginning downstream of the diverter wedge 42. In particular, collator belt 92 is transported around idler roller 90, roller 96, idler roller 100, and idler roller 108. Collator belt 94 is transported around idler roller 90, roller 98, idler roller 100, and idler roller 112. Belt take-up idler rollers 93, 95 also define the paths of the collator belts and are operable to adjust the tension in each belt loop. Similarly, the tension of diverter belts 78, 80 can also be adjusted with belt take-up rollers A and B, which are connected via a pivotable lever arm to an air actuator that applies adjustable pressure. Since the tension in all four belts can be adjusted, adjustable pressure between opposed belts results to positively hold and transport signatures at tape speed.

Rollers 62 and 96 include two similar gears (not shown) which mesh so that belt 92 is driven at the same speed as belt 78. Similarly, rollers 64 and 98 include gears (not shown) which mesh so that belt 94 is driven at the same speed as belt 80 (which speed is the same speed as belt 78).

The secondary signature control means 72 also includes a soft nip 122 defined by idler roller 66 operating with the abaxially disposed idler roller 108, the diverter belt 78, and the collator belt 92. Similarly, the secondary signature control means 74 includes a soft nip 124 defined by idler roller 68 operating with the abaxially disposed idler roller 112, the diverter belt 80, and the collator belt 94.

Figure 2:
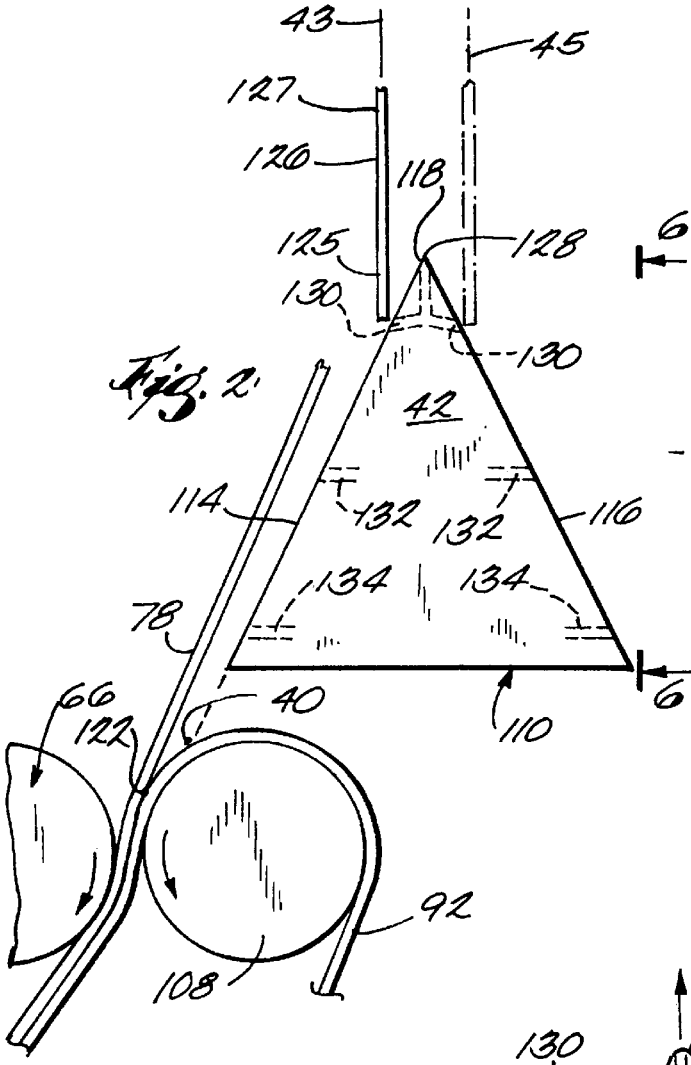
FIG. 2 is an illustration of the diverter wedge which includes air discharge ports in accordance with the present invention.
Figure 6:
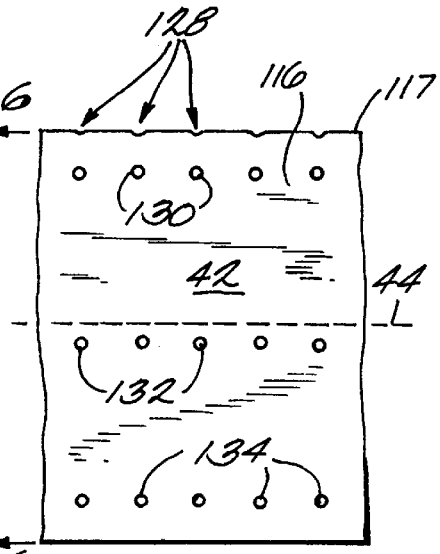
FIG. 6 is an illustration of the diverter wedge viewed from line 6—6 in FIG. 2.
Figure 5:
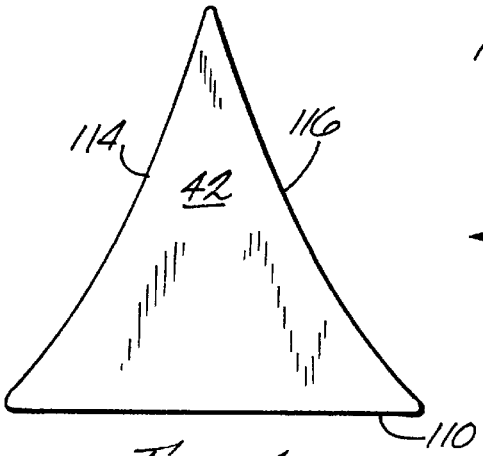
FIG. 5 is an illustration of another alternative embodiment of the present invention and shows a diverter wedge including concave diversion surfaces.

A preferred embodiment of the diverter wedge 42 is illustrated in FIGS. 2 and 6. The diverter wedge 42 is an elongated bar having a longitudinal axis 44 (shown in FIG. 6) and a generally triangular cross section transverse to the longitudinal axis 44. The wedge 42 is fixed in position and includes a base 110 and two sides defining diverging planar diversion surfaces 114, 116. Preferably, as shown in FIG. 2, the wedge is an isosceles triangle in cross section. Alternately, as shown in FIG. 5, the diverter wedge 42 may include diversion surfaces 114, 116 which are concave, or curved about an axis generally parallel to the longitudinal axis 44. In any case, the vertex edge 117 of the wedge 42 opposite base 110 and closest to the diverter rolls 58 and 60 has a radiused or rounded surface 118. Diversion surfaces 114, 116 diverge from vertex edge 117.

The wedge 42 also includes a plurality of air discharge ports located in spaced apart relation on the outer periphery of the wedge 42. In particular, one or more air discharge ports 128 are located on the vertex edge 117 of the wedge 42, and several other air discharge ports are located at spaced distances to intersect each respective planar diversion surface 114, 116. Air discharge ports 130 are angled downwardly from the horizontal (defined by the base 110), while air discharge ports 132 and 134 are arranged generally horizontally with respect to the base 110. It is also contemplated that the air discharge ports 130, 132, and 134 be oriented perpendicularly to the planar diversion surfaces 114, 116, i.e., the axis of each port would be perpendicular to the planar diversion surface. FIG. 6 is an illustration of a side view of diverter wedge 42 as viewed from line 6—6 of FIG. 2 and shows the orientation and size of the air discharge ports 128, 130, 132 and 134.

Figure 3:
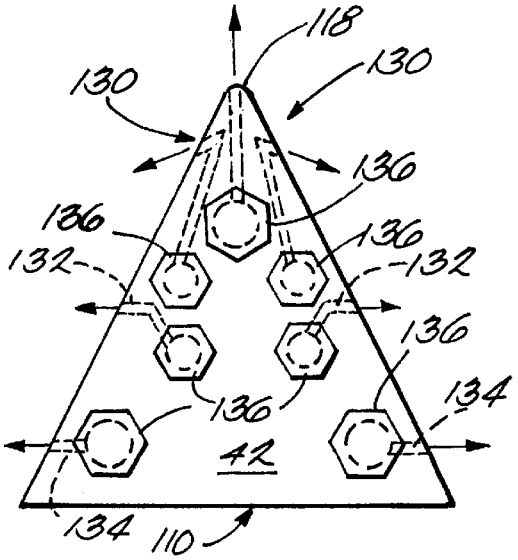
FIG. 3 is an illustration of the opposite side of the diverter wedge depicted in FIG. 2.

As shown in FIG. 3, the back end of the wedge 42 is provided with a plurality of air inlet ports 136 which are adapted to receive fittings for air lines through which pressurized air is supplied from a pressurized air source to the wedge. Each air inlet port 136 is connected internally of the wedge to a row of air discharge ports along the depth of the wedge. The air inlet ports 136 could also be provided on the front end or on the base 110 of the wedge. For example, including an air inlet port on both the front and back ends of the wedge for one row of air discharge ports would provide a more even distribution of air coming out of each air discharge port. An air pressure regulator or a pneumatic needle valve arrangement (not shown) can be added to each inlet air line for individual pressure control of each inlet air line. The air flow pressure adjustment, like a pneumatic needle valve would provide, could be done either internal or external of the diverter wedge.

In operation, as a signature 126 approaches the diverter along diverter path 36, diverting mechanism 40 diverts the signature 126 with the aid of the diverter wedge 42 to the correct one of the two collation paths 43, 45. The following is a description of what happens as the signature 126 follows collation path 43. A similar description is applicable when the signature 126 follows collation path 45. Pressurized air is discharged from ports 130 and directed slightly downward. Pressurized air is discharged from the other ports 132, 134, 118 as well. An air flow boundary layer is created between the wedge 42 and the signature 126, a portion of which air layer follows the signature 126 as it is driven along the diversion surface 114 of the wedge 42. The air flow layer lessens the impact of the leading edge 125 of the signature 126 on the wedge 42, reduces friction between the signature 126 and the diversion surface 114 and additionally forces the signature 126 against the belt 78 for improved positive drive. The reduction in friction between the signature 126 and the diversion surface 114 reduces the amount of ink offset to the diverter wedge 42 and also reduces the amount of static electricity generated by the rubbing action of the signature body against the diversion surface 114. The flow of pressurized air from ports 132 and 134 causes the leading edge 125 of the signature 126 to strike belt 92 at the soft nip 122 defined between the two belts 78, 92. Soft nip 122 is offset from a plane defined by the planar diversion surface 114 of the wedge 42. A strike point at the soft nip 122 is preferable to hitting the belt 92 at point 140 (which lies on the plane defined by planar surface 114) because there is less of an impact force at the soft nip 122.

Pressurized air discharged from the plurality of ports 128 supports the trailing portion 127 of the signature 126 as the signature 126 follows the collation path 43 so the trailing portion 127 does not hit as hard on the wedge top vertex edge. The radiused edge of the vertex 118 also helps to prevent signature damage, such as tearing or dog-ears, to the trailing portion 127 of the signature 126. These features allow the printing press and folder to be run at faster speeds than was previously possible.

Figure 4:
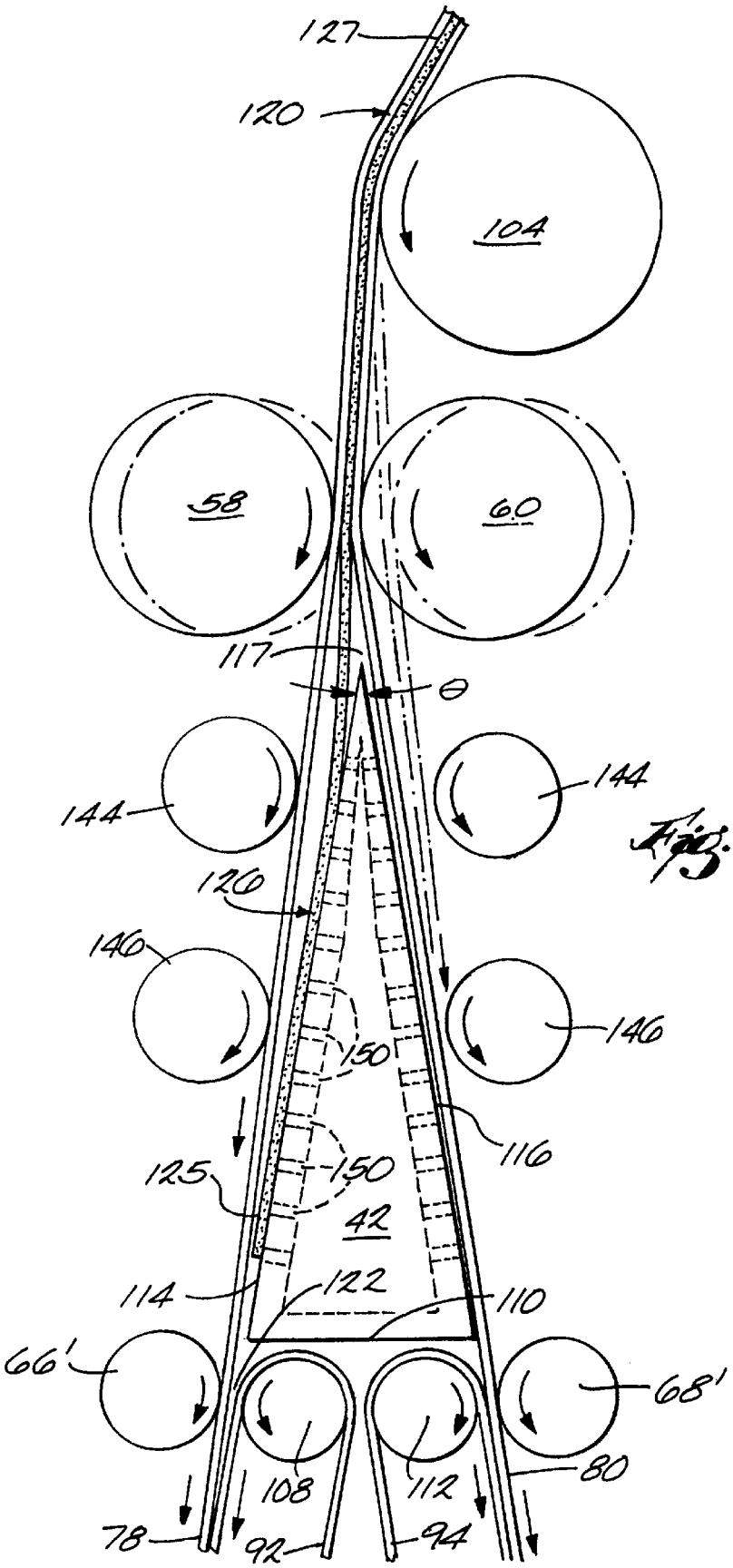
FIG. 4 is an illustration of an alternate embodiment of the diverter wedge in accordance with the present invention.

FIG. 4 illustrates a second embodiment of the diverter wedge 42 and portions of the primary signature control means 70 and secondary signature control means 72, with the understanding that control means 74 is identical to control means 72. In this embodiment, the wedge 42 is also fixed in position, and is an elongated bar having a longitudinal axis and a generally triangular cross section transverse to the longitudinal axis. In this embodiment, however, the diversion surfaces 114, 116 define a much smaller angle e at the vertex edge 117 as compared to the previous embodiment. The angle θ is approximately 20°. The length of the base 110 of the wedge 42 is sufficient to accommodate idler rollers 108, 112 and separate collating tapes 92, 94. Guide rollers 144, 146 have been added for guiding the belt 78 near the diversion surface 114 of the wedge 42. The guide rollers 144, 146 move the belt 78 closer to the diversion surface 114 of wedge 42, to hug the surface while allowing a gap large enough to accommodate the thickness of the signature without compressing it. Also, the position of roller 66' has been moved from the position of roller 66 in FIGS. 1 and 2 so that its axis is in the same horizontal plane as the axis of roller 108. Roller 68' has been similarly moved. The nip formed between rollers 66' and 108 is closer to the plane formed by a planar diversion surface 114 of the wedge 42. Because of the smaller angle θ at the top vertex edge of the diverter wedge, the distance through the diverter between the soft nip 120 formed by rollers 102 and 104 and the nip formed between rollers 66' and 108 is now greater than the length of the signature to be diverted. In order to exert a positive driving force without slipping on the signature 126 when the signature is between nip 120 and nip 122, the wedge 42 includes a plurality of air discharge ports 150 with corresponding air input ports connected to the air discharge ports and connectable to a source of pressurized air.

The following describes the operation of the diverter wedge as the signature is fed down the left hand side of the wedge, with the understanding that the operation is similar when the signature is fed down the right hand side of the wedge.

In operation, the leading edge 125 of a signature 126 is directed by the primary signature control means 70 to the wedge 42. As the trailing portion 127 of signature 126 is released from upper nip 120, the pressurized air from the air discharge ports 150 along the diversion surface 114 operates in conjunction with the belt 78 to provide a positive driving force without slipping for the signature 126 and control of the leading edge 125 of the signature 126 until the leading edge 125 reaches the nip 122. Because of the small angle θ at the vertex edge 117 defined by the diversion surfaces 114, 116, the angle of impact of the leading edge 125 of the signature 126 on the diversion surface 114 of the wedge is reduced, thereby lessening the impact force and the damage to the leading edge of the signature at a given press speed. Note that the angle of impact is the angle θ divided by two. In the preferred embodiment, θ=20 degrees so that the impact angle is 10 degrees.

Also, the signature 126 is rotated through a smaller divert angle, defined as the angle between the incoming signature before the wedge, and the outgoing signature after passing the wedge. A smaller divert angle means less ink offset to the wedge. In the embodiment illustrated, the vertex angle θ is 20° and a signature diverted to the left is diverted by 10°, as is a signature diverted to the right. In the preferred embodiment, the divert angle for signatures diverted to the left is equal to the divert angle for signatures diverted to the right. However, unequal divert angles can also be employed. The reduction in the impact force on the signature and the reduction in the amount of ink offset means that the folder and the printing press can be operated at a higher rate of speed than previously possible.

Another way to minimize the vertex angle θ is to move one of the rollers 108, 112 of FIG. 4 lower than, and partially tucked under, the other. Further, the wedge diversion surface could be extended on the side where the roller is lower.

The foregoing description of the present invention has been presented for purposes of illustration and description. Furthermore, the description is not intended to limit the invention to the form disclosed herein. Consequently, variations and modification commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A diverter wedge for a pinless folder, the diverter wedge adapted for cooperative association with a diverter guide mechanism operating to direct the lateral disposition of the leading edge of a signature relative to the vertex of the wedge to one of a plurality of collation paths, the diverter wedge comprising:

an elongated bar having a longitudinal axis and a generally triangular cross section transverse to the longitudinal axis, the bar including a base, a vertex edge opposite the base, and planar diversion surfaces diverging from the vertex edge;

an air inlet port connectable to a source of pressurized air; and a plurality of air discharge ports connected to the air inlet port and intersecting one of the planar diversion surfaces, wherein at least one air discharge port intersects the vertex edge.

2. The diverter wedge of claim 1, wherein the vertex edge defines a generally rounded surface.

3. The diverter wedge of claim 1, wherein the generally triangular cross section is an isosceles triangle.

4. The diverter wedge of claim 1, wherein the diversion surfaces are curved about an axis generally parallel to the longitudinal axis.

5. The diverter wedge of claim 1, wherein one or more of the plurality of air discharge ports is oriented to direct air in a direction generally parallel to the base.

6. The diverter wedge of claim 1, wherein one or more of the plurality of air discharge ports is oriented to direct air in a direction outwardly from the bar and downwardly.

7. The diverter wedge of claim 1, wherein one or more of the plurality of air discharge ports is oriented to direct air in a direction generally perpendicular to one of the planar diversion surfaces.

8. A diverter wedge for a pinless folder, the diverter wedge adapted for cooperative association with a diverting guide mechanism operating to direct the lateral disposition of the leading edge of a signature relative to a vertex of the wedge to one of a plurality of collation paths, the diverter wedge comprising:

an elongated bar having a longitudinal axis and a generally triangular cross section transverse to said longitudinal axis, the bar including a base, a vertex edge opposite the base, and planar diversion surfaces diverging from the vertex edge;

a plurality of air inlet ports each individually connectable to an air pressure regulator and to a source of pressurized air; and a first row of air discharge ports intersecting one of the planar diversion surfaces, the first row of air discharge ports connected to one of the plurality of air inlet ports, and a second row of air discharge ports intersecting the other planar diversion surface, the second row of air discharge ports connected to another one of the plurality of air inlet ports.

9. The diverter wedge of claim 8, wherein the vertex edge defines a generally rounded surface.

10. The diverter wedge of claim 8, wherein the cross section is an isosceles triangle.

11. The diverter wedge of claim 8, wherein the diversion surfaces are curved about an axis generally parallel to the longitudinal axis.

12. The diverter wedge of claim 8, wherein one or more of the plurality of air discharge ports is oriented to direct air in a direction generally perpendicular to one of the respective diversion surfaces.

13. The diverter wedge of claim 8, further comprising:

at least one additional air discharge port which intersects the vertex edge and which is connected to yet another one of the plurality of air inlet ports.

* * * * *